US010931054B2

(12) United States Patent
Saito et al.

(10) Patent No.: US 10,931,054 B2
(45) Date of Patent: Feb. 23, 2021

(54) CONNECTOR STRUCTURE INCLUDING PLATE SPRING MEMBER PROVIDED AT BOTTOM OF MATING HOOD, AND BACKLASH REGULATING MEMBER PROVIDED ON OPPOSITE SIDE OF MATING HOOD BOTTOM AND URGED OPPOSITE TO FITTING DIRECTION OF MATING HOOD BY PLATE SPRING MEMBER

(71) Applicant: Yazaki Corporation, Tokyo (JP)

(72) Inventors: Masayuki Saito, Makinohara (JP); Tadashi Hasegawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/734,996

(22) Filed: Jan. 6, 2020

(65) Prior Publication Data

US 2020/0251847 A1 Aug. 6, 2020

(30) Foreign Application Priority Data

Feb. 4, 2019 (JP) ..... JP2019-017832

(51) Int. Cl.
*H01R 13/502* (2006.01)
*H01R 13/627* (2006.01)
(Continued)

(52) U.S. Cl.
CPC ..... *H01R 13/5025* (2013.01); *H01R 13/6272* (2013.01); *H01R 13/42* (2013.01); *H01R 13/5202* (2013.01)

(58) Field of Classification Search
CPC ..... H01R 13/5025; H01R 13/6272; H01R 13/42; H01R 13/5202
(Continued)

(56) References Cited

U.S. PATENT DOCUMENTS 4,874,325 A * 10/1989 Bensing ..... H01R 13/5219 439/272
5,334,039 A * 8/1994 Kanda ..... C08J 5/124 264/135

(Continued)

FOREIGN PATENT DOCUMENTS

| | | | |
|---|---|---|---|
| EP | 1764879 | A1 | 3/2007 |
| JP | 2005-019287 | A | 1/2005 |
| JP | 2005-174813 | A | 6/2005 |

OTHER PUBLICATIONS

Jun. 8, 2020—(EP) Extended EP Search Report—App 20150186.3.
Nov. 18, 2020—U.S. Non-Final Office Action—U.S. Appl. No. 16/776,940.

*Primary Examiner* — Harshad C Patel
(74) *Attorney, Agent, or Firm* — Banner & Witcoff, Ltd.

(57) ABSTRACT

A connector structure includes a bottomed tubular hood formed in a housing, a mating hood formed in a mating housing and fitted inside the bottomed tubular hood, a plate spring member made of metal accommodated in a tube bottom of the bottomed tubular hood, a backlash regulating member provided on an opposite side of the tube bottom across the plate spring member and urged in a direction opposite to a fitting direction of the mating hood by the plate spring member, a mating hood tip end surface formed at a tip end of the mating hood in the fitting direction, and a regulating member abutting surface provided on the backlash regulating member and pressed by the mating hood tip end surface in a fitted state that the housing and the mating housing are fitted.

4 Claims, 18 Drawing Sheets

(51) Int. Cl.
*H01R 13/42* (2006.01)
*H01R 13/52* (2006.01)

(58) Field of Classification Search
USPC ..... 439/382, 272.274, 275, 273, 278–282, 439/587
See application file for complete search history.

(56) References Cited

U.S. PATENT DOCUMENTS

| | | | | |
|---|---|---|---|---|
| 5,820,400 | A * | 10/1998 | Yamanashi | H01R 13/6272 439/358 |
| 6,648,700 | B1 * | 11/2003 | Greiner | H01R 13/64 439/382 |
| 7,214,080 | B2 | 5/2007 | Ichio et al. | |
| 2004/0266243 | A1 * | 12/2004 | Murakami | H01R 13/6277 439/271 |
| 2007/0059970 | A1 * | 3/2007 | Ichio | H01R 13/6272 439/382 |

* cited by examiner

CONNECTOR STRUCTURE INCLUDING PLATE SPRING MEMBER PROVIDED AT BOTTOM OF MATING HOOD, AND BACKLASH REGULATING MEMBER PROVIDED ON OPPOSITE SIDE OF MATING HOOD BOTTOM AND URGED OPPOSITE TO FITTING DIRECTION OF MATING HOOD BY PLATE SPRING MEMBER

CROSS REFERENCE TO RELATED APPLICATIONS

This application claims priority from Japanese Patent Application No. 2019-017832 filed on Feb. 4, 2019, the entire contents of which are incorporated herein by reference.

BACKGROUND OF THE INVENTION

Field of the Invention

The present invention relates to a connector structure.

Description of Related Art

There has been known a technique for providing a connector structure without rattle (for example, Patent Literature 1). As shown in FIG. 18, the connector structure includes a connector 503 including a hood 501 and a mating connector 507 including a mating hood 505. In the mating connector 507, a packing 509 that is an elastic member made of a resin is disposed inside the mating hood 505. In a fitting state of both connectors, the hood 501 of the connector 503 is inserted into the mating hood 505 of the mating connector 507, and a tip end of the hood 501 presses a protruding piece 511 of the packing 509 to suppress a backlash between the connector 503 and the mating connector 507 in a fitting axial direction.

[Patent Literature 1] JP-A-2005-174813

In the conventional connector structure, the packing 509 is accommodated in a fitting space of the mating hood 505, and the hood 501 is also inserted into the fitting space, so that the fitting space is effectively used.

However, since the packing 509 is the elastic member made of the resin, there is a concern that an elastic repulsive force is reduced due to deterioration due to long-term use, and an effect of suppressing the backlash is reduced. As a result, due to vibration during traveling of a vehicle or the like, an electrical connection reliability may be reduced due to fine sliding wear between a male tab 513 and a contact spring 515 of a female terminal.

SUMMARY

One or more embodiments provide a connector structure capable of obtaining a stable vibration resistant effect even after aging.

In an aspect (1), one or more embodiments provide a connector structure including a bottomed tubular hood formed in a housing, a mating hood formed in a mating housing and fitted inside the hood, a plate spring member made of metal accommodated in a tube bottom of the hood, a backlash regulating member provided on an opposite side of the tube bottom across the plate spring member and urged in a direction opposite to a fitting direction of the mating hood by the plate spring member, a mating hood tip end surface formed at a tip end of the mating hood in the fitting direction, and a regulating member abutting surface provided on the backlash regulating member and pressed by the mating hood tip end surface in a fitted state that the housing and the mating housing are fitted.

According to the aspect (1), the plate spring member made of metal is provided at the tube bottom of the hood. The backlash regulating member is provided on an opposite side of the tube bottom across the plate spring member. The backlash regulating member is urged in a direction opposite to a fitting direction of the mating hood by the plate spring member. The backlash regulating member is provided with the regulating member abutting surface. Immediately before completion of fitting, the regulating member abutting surface is pressed by the mating hood tip end surface formed at a tip end of the mating hood in the fitting direction. The backlash regulating member including the regulating member abutting surface pressed by the mating hood tip end surface compresses and deforms the plate spring member against a spring force (elastic restoring force). When an insertion force for the fitting is released, the mating housing is urged by the elastic restoring force of the plate spring member and pushed back in the direction opposite to the fitting direction.

Therefore, in the mating housing pushed back by the elastic restoring force of the plate spring member, a mating locking surface of a lock projection provided on the mating housing is came into close contact with an arm side locking surface of a lock arm provided on the housing, and a clearance in a lock mechanism can be eliminated. That is, the backlash by the clearance in the lock mechanism that fits and locks both of the housings is reduced. Accordingly, in the connector structure according to the present configuration, in the fitted and locked state of the both housings, a movement of the mating locking surface of the lock projection and the arm side locking surface of the lock arm in an approaching/separating direction due to the clearance in the lock mechanism becomes impossible. As a result, in the connector structure according to the present configuration, even when vibration occurs when the vehicle is traveling or the like, fine sliding between a terminal accommodated in the housing and a mating terminal accommodated in the mating housing can be suppressed. In the connector structure according to the present configuration, the plate spring member that pushes back the mating housing so as to eliminate the clearance in the lock mechanism is made of a metal elastic member. Therefore, the plate spring member is less likely to creep due to aging such as an elastic member made of rubber or resin. That is, a push-back force acting on the mating housing can be maintained for a long period of time. Therefore, the plate spring member can maintain an elastic repulsive force of the spring portion even in long-term use, and can suppress the backlash in the fitting direction between the housing and the mating housing. Therefore, according to the connector structure of the present configuration, abrasion powder generated by the fine sliding wear between the terminal and the mating terminal can be suppressed from being an oxide insulator, so that a contact reliability between the terminal and the mating terminal can be suppressed from being reduced. Therefore, it is possible to maintain a good contact reliability over a long period of time.

In an aspect (2), the connector structure may further include an insertion portion formed on the mating hood tip end surface, and a backlash regulating protruding portion provided on the regulating member abutting surface and including a V-shaped groove formed by an inner side bending piece bent toward an inside of a tube of the hood and an outer side bending piece bent to an outside of the tube of the hood. The V-shaped groove of the backlash regulating protruding portion is pressed by the insertion portion.

According to the aspect (2), in the fitting process of the housing and the mating housing, the insertion portion formed on the mating hood tip end surface is inserted into the V-shaped groove of the backlash regulating protruding portion. When further inserted, the spring portion of the plate spring member is pressed and elastically deformed by the backlash regulating member, and the elastic restoring force is generated in the spring portion of the plate spring member. Then, due to the urging of the elastic restoring force of the spring portion, the insertion portion bends and deforms the inner side bending piece and the outer side bending piece of the backlash regulating protruding portion configuring the V-shaped groove, respectively.

Therefore, in the fitted state of the housing and the mating housing, the lock projection and the lock arm in the lock mechanism are engaged, and the insertion portion maintains the inner side bending piece and the outer side bending piece of the backlash regulating protruding portion in a bent state. As a result, due to the bending of the inner side bending piece and the outer side bending piece provided in the backlash regulating protruding portion of the backlash regulating member, backlash due to clearance in a direction orthogonal to a housing fitting direction between the housing and the mating housing is suppressed. Therefore, in the fitted state of the housing and the mating housing, even if the vibration is applied to the vehicle, the fine sliding wear due to the terminal and the mating terminal is suppressed, and an electrical connection reliability is improved.

In an aspect (3), at least one backlash regulating protruding portion may be provided on each of the regulating member abutting surfaces in an upper-lower direction and a left-right direction which are orthogonal to a tubular center axis of the hood and orthogonal to each other.

According to the aspect (3), at least four backlash regulating protruding portions provided on the regulating member abutting surface are provided on upper and lower sides of the regulating member abutting surface that sandwich the tubular center axis of the hood vertically and left and right sides of the regulating member abutting surface that sandwich the tubular center axis of the hood on the left and right. Incidentally, a pair of the backlash regulating protruding portions may be provided on one of the four sides (for example, an upper side of the regulating member abutting surface) with the tubular center axis interposed therebetween. In this case, a total of five backlash regulating protruding portions are provided. As described above, in the connector structure according to the present configuration, the backlash regulating protruding portions provided on the regulating member abutting surface are arranged radially in four directions sandwiching the tubular center axis in the upper-lower and left-right directions. Therefore, the mating hood tip end surface abuts against the backlash regulating member substantially uniformly in a radial direction around the tubular center axis. As a result, an urging force of the plate spring member acting on the mating hood tip end surface via the backlash regulating member is substantially uniform in the radial direction around the tubular center axis. As a result, the backlash regulating member can maintain a high degree of parallelism with the tube bottom even when the plate spring member is pressed and moved or when the mating hood is pushed back. Therefore, in the connector structure according to the present configuration, it is possible to prevent the backlash regulating member from being inclined with respect to the tube bottom and causing the backlash reducing action to be uneven in the radial direction.

In an aspect (4), the backlash regulating member may be provided with a displacement preventing projection abutting against the tube bottom. The displacement preventing projection may be configured to prevent from an excessive displacement of the plate spring member.

According to the aspect (4), the backlash regulating member includes the displacement preventing projection protruding toward the tube bottom. When the connector and the mating connector are fitted, the backlash regulating member presses the plate spring member toward the tube bottom when the regulating member abutting surface is pressed by the mating hood tip end surface. The spring portion provided on the plate spring member is compressed and deformed by this pressing. In a process of compressing and deforming the spring portion of the plate spring member, the displacement preventing projection abuts against the tube bottom before displacement exceeding an elastic limit is applied. Accordingly, further displacement of the spring portion of the plate spring member is regulated. As a result, in the connector structure according to the present configuration, the spring portion of the plate spring member can be prevented from being excessively deformed beyond the elastic limit and plastically deformed, so that a stable backlash reducing action can be maintained.

In an aspect (5), an abutting start position of the mating hood tip end surface and the regulating member abutting surface may be set to a predetermined stroke position, so that the mating hood tip end surface and the regulating member abutting surface are abutted after a fitting force of the housing and the mating housing reaches a maximum.

According to the aspect (5), the abutting of the mating hood tip end surface and the regulating member abutting surface starts after the fitting force of the housing and the mating housing reaches the maximum. That is, in the fitting process of the housing and the mating housing, the lock arm first comes into contact with the lock projection of the mating housing in the lock mechanism, and a lock insertion load starts to occur, for example. Next, the mating hood and the packing come into contact with each other, and a packing insertion load starts to occur. Then, the mating terminal and the terminal come into contact with each other, and a terminal insertion load starts to occur. As a result, all three of the lock insertion load, the packing insertion load, and the terminal insertion load, which are elements of the connector insertion force, are generated.

In the connector structure according to the present configuration, the connector insertion force is maximized in this state. In the connector structure according to the present configuration, after the connector insertion force reaches the maximum, the abutting of the mating hood tip end surface and the regulating member abutting surface is started. As a result, the spring load of the spring portion of the plate spring member starts to occur. However, when the spring load is generated, a time point when the connector insertion force becomes maximum has passed. That is, only the respective static loads are generated. Therefore, the connector structure according to the present configuration is configured such that the generation of the spring load does not increase the connector insertion force.

According to one or more embodiments, a stable vibration resistant effect can be obtained even after aging.

The present invention has been briefly described above. Further, details of the present invention will be clarified by reading a mode for carrying out the invention to be described below with reference to accompanying drawings.

BRIEF DESCRIPTION OF THE DRAWINGS

FIG. 5A is a plan sectional view of a hood to which the plate spring member is mounted. FIG. 5B is a plan sectional view of the hood to which the plate spring member and the backlash regulating member are mounted.

DETAILED DESCRIPTION

Embodiments of the present invention will be described below with reference to the drawings.

Figure 1:
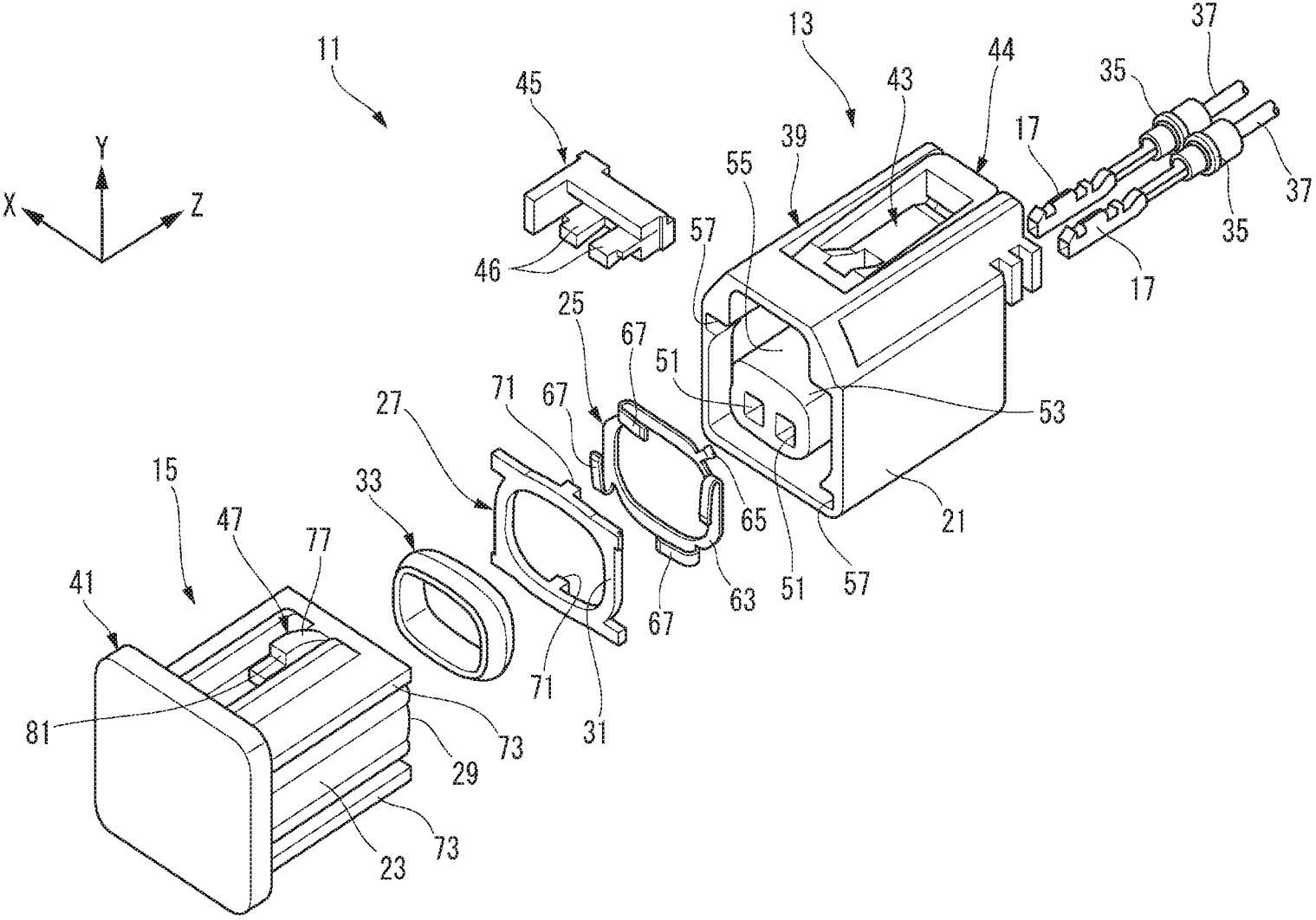
FIG. 1 is an exploded perspective view of a high vibration resistant connector including a connector structure according to a first embodiment.

FIG. 1 is an exploded perspective view of a high vibration resistant connector 11 including a connector structure according to a first embodiment of the present invention. In the present specification, X, Y and Z directions follow directions of arrows shown in FIG. 1.

The connector structure according to the first embodiment is applied to the high vibration resistant connector 11.

The high vibration resistant connector 11 is configured to fit a connector 13 and a mating connector 15. In the first embodiment, the connector 13 is a female connector. The mating connector 15 is a male connector. The mating connector 15 can be formed as a part of an auxiliary machine, for example. The connector 13 accommodates, for example, two female terminals 17 formed in a box shape. The mating connector 15 accommodates, for example, two male mating terminals 19 (see FIG. 8) formed in a tab shape. Incidentally, a shape and the number of the terminals of the connector structure are not limited thereto.

The connector structure according to the first embodiment mainly includes a hood 21 of the connector 13, a mating hood 23 of a mating connector 15, a plate spring member 25, a backlash regulating member 27, a mating hood tip end surface 29 (see FIG. 6) of the mating connector 15, and a regulating member abutting surface 31 of the backlash regulating member 27.

In addition, the connector structure according to the first embodiment includes a packing 33, rubber plugs 35, electric wires 37, a housing 39 of the connector 13, a mating housing 41 of the mating connector 15, a lock arm 43, a side spacer 45, and a lock projection 47.

Figure 2:
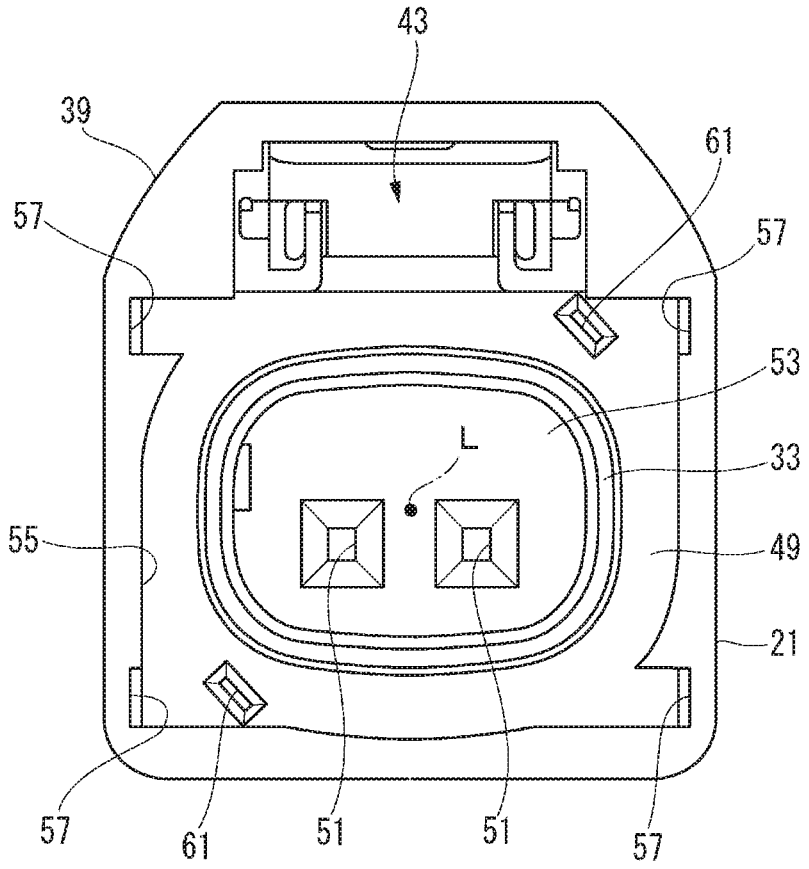
FIG. 2 is a front view of the connector shown in FIG. 1.

FIG. 2 is a front view of the connector 13 shown in FIG. 1.

The hood 21 of the connector 13 is formed integrally with the housing 39 made of an insulating resin, and is formed in a substantially rectangular bottomed tubular shape. A tube bottom 49 is a back wall of the housing 39. An inner tube portion 53 formed with terminal receiving ports 51 protrudes coaxially inside the hood 21. An annular fitting space 55 is formed between the inner tube portion 53 and the hood 21. The mating hood 23 of the mating connector 15 is fitted into the fitting space 55. In the fitting space 55, grooves 57 extending along a tubular center axis L are formed above and below the inner tube portion 53 so as to sandwich the inner tube portion 53. Each of the grooves 57 is provided with a locked protruding portion 59 (see FIGS. 5A and 5B). A pair of press-fitting holes 61 are formed on both sides of a line segment connecting a pair of diagonal corners of the tube bottom 49 of the fitting space 55.

Figure 3:
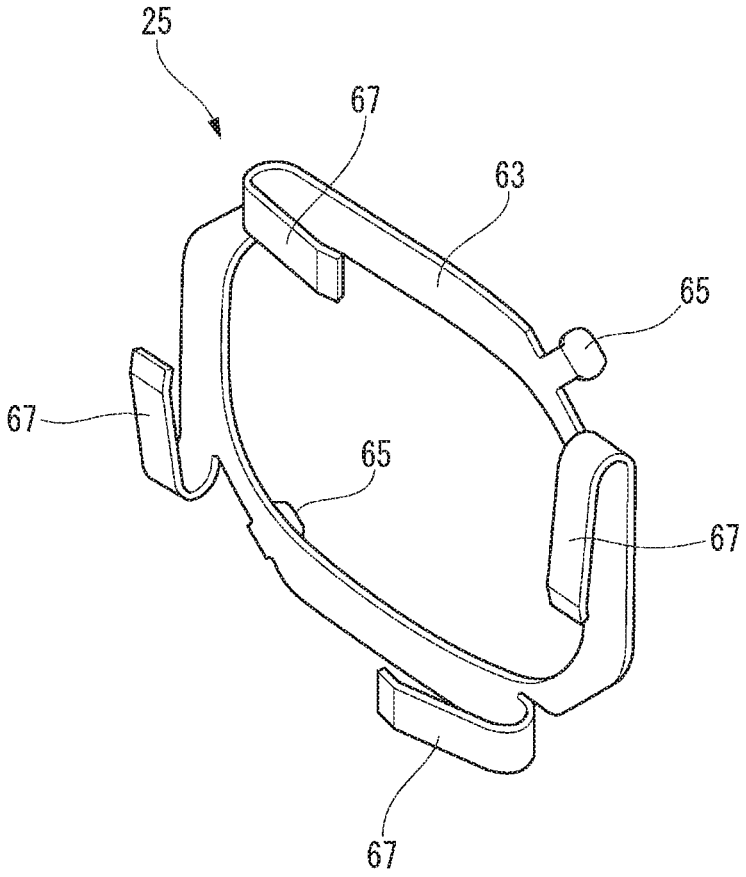
FIG. 3 is a perspective view of a plate spring member shown in FIG. 1.

FIG. 3 is a perspective view of the plate spring member 25 shown in FIG. 1.

The plate spring member 25 made of metal is accommodated in the tube bottom 49 of the hood 21. The plate spring member 25 includes a plate spring main body portion 63. The plate spring member 25 is formed in a square frame shape obtained by punching a metal plate parallel to the tube bottom 49 into a substantially rectangular shape. A pair of press-fitting projections 65 protrude from a surface of the plate spring main body portion 63 facing the tube bottom 49 so as to correspond to the press-fitting holes 61. Four spring portions 67 are integrally formed on a surface of the plate spring main body portion 63 on a side not facing the tube bottom 49. The spring portions 67 are formed by bending so as to overlap along sides of the plate spring main body portion 63, respectively. Each of the spring portions 67 is formed as a plate spring with a bent tip end as a free end.

Figure 4:
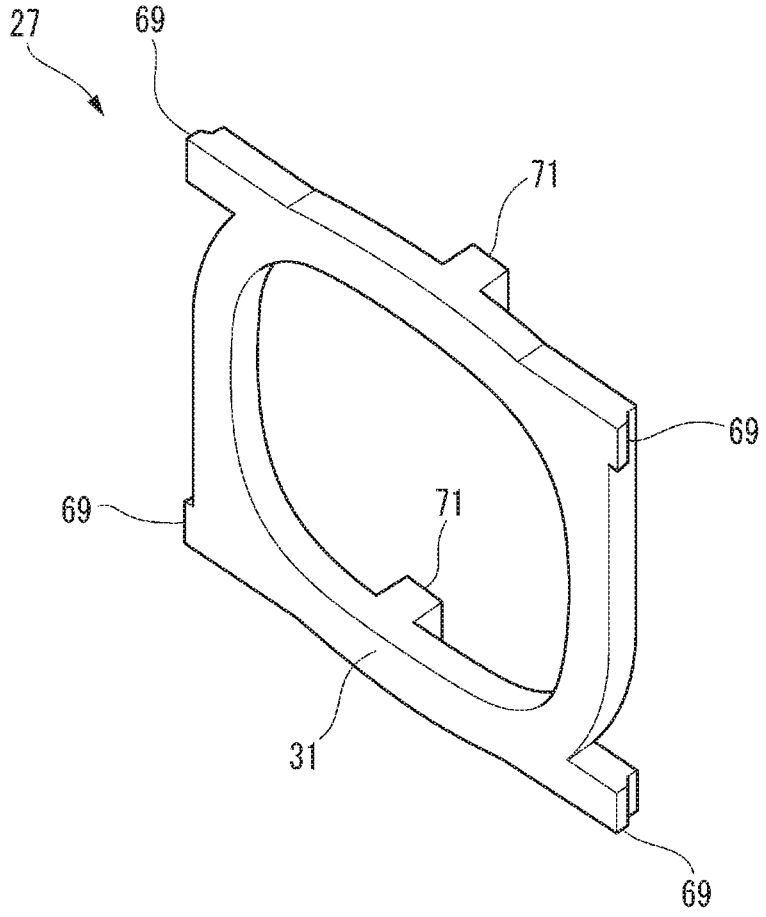
FIG. 4 is a perspective view of a backlash regulating member shown in FIG. 1.

FIG. 4 is a perspective view of the backlash regulating member 27 shown in FIG. 1.

The backlash regulating member 27 is formed of an insulating resin material. The backlash regulating member 27 is formed in a square frame shape substantially similar to the plate spring main body portion 63. The backlash regulating member 27 is mounted on an opposite side of the tube bottom 49 across the plate spring member 25. The backlash regulating member 27 is urged in a direction opposite to a fitting direction (Z direction) of the mating hood 23 by the spring portions 67 of the plate spring member 25. On both sides of an upper side portion and both sides of a lower side portion of the backlash regulating member 27, protruding portions 69 protruding in extending directions of the side portions thereof are formed. The protruding portions 69 are respectively locked to the locked protruding portions 59 provided in the grooves 57 described above. As a result, the backlash regulating member 27 is movable along a fitting direction (Z direction) of the mating hood 23, and is regulated from falling-off from the hood 21 of the connector 13.

A pair of displacement preventing projections 71 protrude from an upper side portion and a lower side portion of a surface of the backlash regulating member 27 facing the tube bottom 49. When the spring portion 67 is displaced by a constant amount, a protruding tip end of the displacement preventing projection 71 abuts against the tube bottom 49.

Figure 5B:
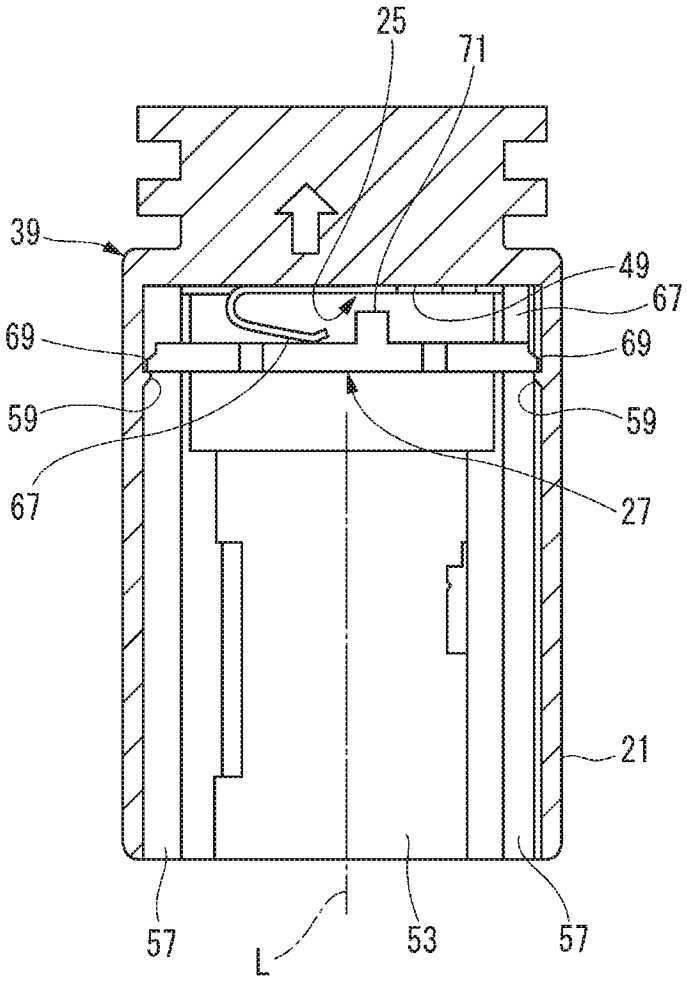
FIGS. 5A and 5B are plan sectional views of the connector shown in FIG. 1.
Figure 5A:
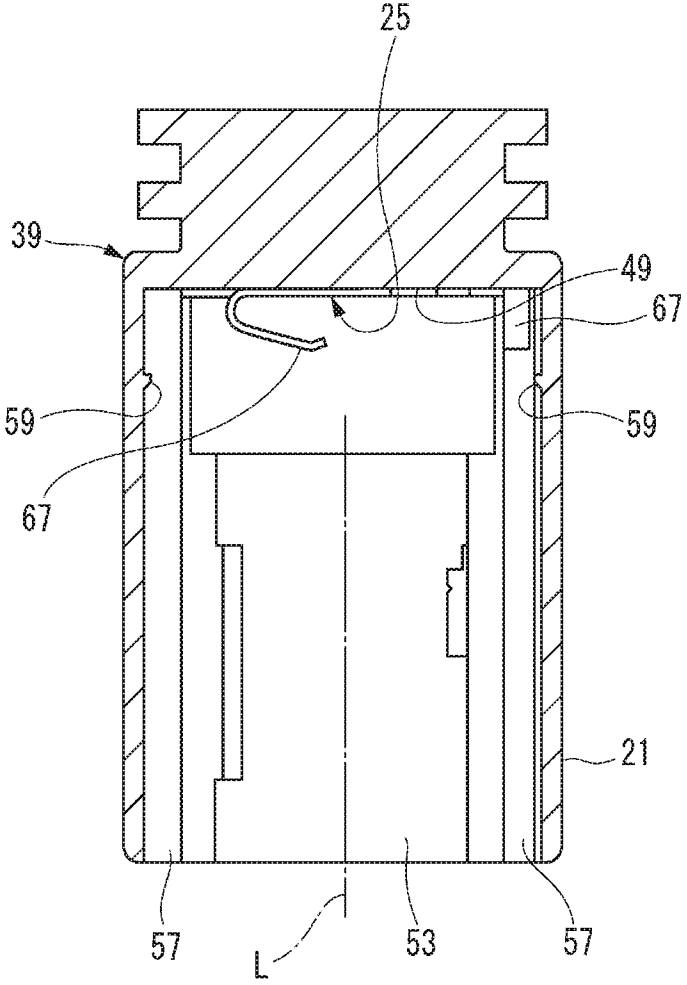

FIGS. 5A and 5B are plan sectional views of the connector 13 shown in FIG. 1. FIG. 5A is a plan sectional view of the hood 21 to which the plate spring member 25 is mounted. FIG. 5B is a plan sectional view of the hood 21 to which the plate spring member 25 and the backlash regulating member 27 are mounted.

As shown in FIG. 5A, the plate spring member 25 is inserted into the fitting space 55 of the hood 21, and the press-fitting projections 65 are respectively press-fitted into the press-fitting holes 61, so that the plate spring main body portion 63 is fixed in close contact with the tube bottom 49 in parallel.

As shown in FIG. 5B, the backlash regulating member 27 is inserted into the fitting space 55 in the hood 21 in which the plate spring member 25 is fixed to the tube bottom 49. When the protruding portions 69 are respectively engaged with the locked protruding portions 59 of the grooves 57, the backlash regulating member 27 is regulated from falling-off from the hood 21, and the mounting is completed. In this engaged state, the spring portion 67 is in a state of being bent by a predetermined amount in advance in an arrow direction shown in FIG. 5B.

When the spring portion 67 is deformed by the predetermined amount in a mounting completed state of the backlash regulating member 27 shown in FIG. 5B, the displacement preventing projection 71 provided in the backlash regulating member 27 abuts against the tube bottom 49. As a result, the displacement preventing projection 71 prevents the spring portion 67 from being deformed excessively beyond an elastic limit and plastically deformed.

Figure 6:
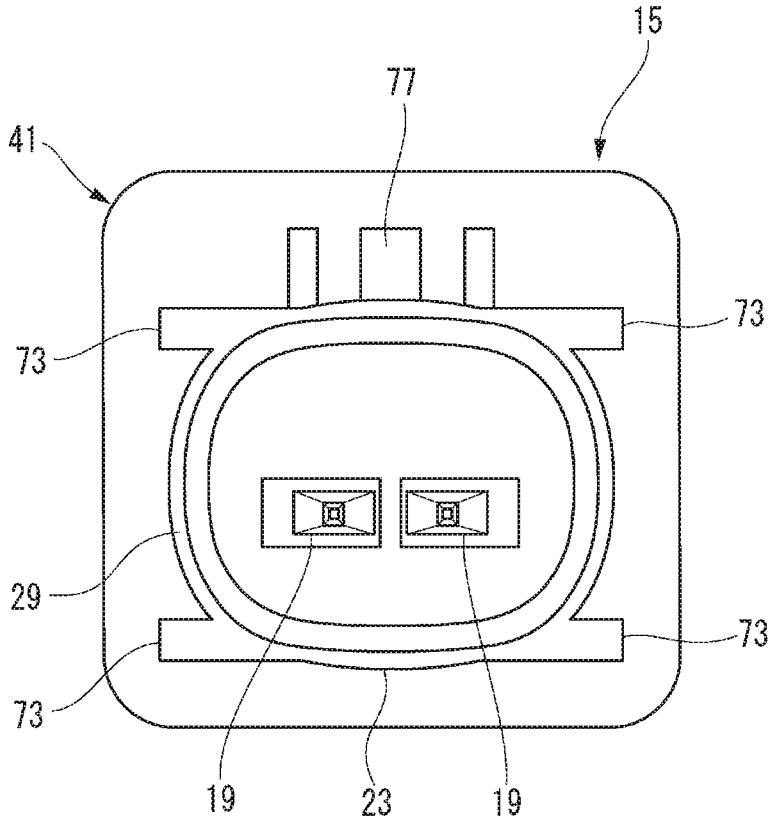
FIG. 6 is a front view of a mating connector shown in FIG. 1.

FIG. 6 is a front view of the mating connector 15 shown in FIG. 1.

The mating hood 23 fitted inside the hood 21 is integrally formed with the mating housing 41 of the mating connector 15. The inner tube portion 53 of the connector 13 is fitted inside the mating hood 23. The pair of mating terminals 19 that enter the terminal receiving ports 51 protrude inside the mating hood 23. On both sides of an upper side portion and both sides of a lower side portion of the mating hood 23, ribs 73 protruding in extending directions of the side portions thereof are formed. The ribs 73 are inserted into the grooves 57 of the hood 21 and serve as a fitting guide, respectively. A mating hood tip end surface 29 is formed at a tip end of the mating hood 23 in the fitting direction (Z direction). Immediately before the completion of the fitting, the mating hood tip end surface 29 abuts against the backlash regulating member 27.

A regulating member abutting surface 31 (see FIG. 4) pressed by the mating hood tip end surface 29 is formed in the backlash regulating member 27 in a fitting state between the housing 39 and the mating housing 41.

The packing 33 is accommodated in the fitting space 55 of the hood 21. The packing 33 is formed in an annular shape by rubber or the like. The packing 33 is mounted on an outer periphery of the inner tube portion 53 to seal the inner tube portion 53 and the mating hood 23 in a watertight manner.

The electric wires 37 are respectively electrically connected to the terminals 17 by crimping or the like. The annular rubber plugs 35 are mounted to outer peripheries of the electric wires 37 connected to the terminals 17, respectively. The rubber plug 35 seals between an electric wire outlet port 74 (see FIG. 8) of the housing 39 from which the electric wire 37 is led out and the electric wire 37. The rubber plug 35 is fixed to the electric wire 37 by, for example, being crimped to a crimping piece of the terminal 17.

The lock arm 43 of the connector 13 is formed in a cantilever shape in which a base end thereof is formed integrally with the housing 39 and the other end thereof extending forward is a free end. The lock arm 43 has an operation arm 44 extending rearward from a free end side. A rear end side of the operation arm 44 serves as an operation portion. The lock arm 43 includes an arm tip end portion 75 that faces the mating hood 23 of the mating connector 15. The arm tip end portion 75 is engaged with the lock projection 47 formed on the mating hood 23. The lock arm 43 and the lock projection 47 form a lock mechanism that fits and locks the connector 13 and the mating connector 15.

The side spacer 45 is inserted into a terminal accommodating chamber from one side surface of the housing 39. By inserting a regulating portion 46 into the terminal accommodating chamber, the side spacer 45 locks a rear end of the terminal 17 to regulate the terminal 17 from coming-off.

Next, a fitting operation of the connector structure according to the first embodiment will be described.

Figure 7:
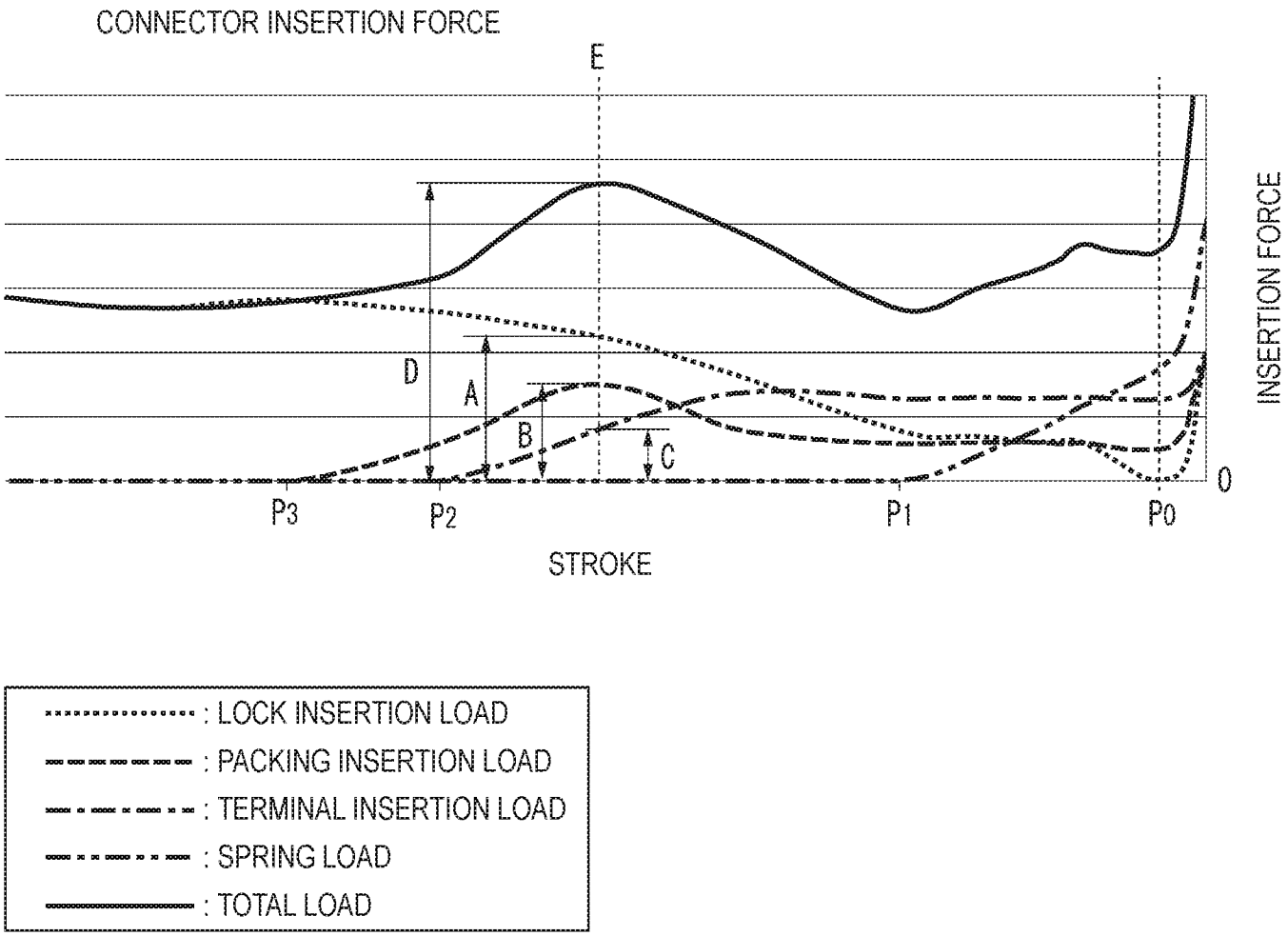
FIG. 7 is a graph showing a correlation between a stroke and an insertion force when the high vibration resistant connector shown in FIG. 1 is fitted.

FIG. 7 is a graph showing a correlation between a stroke and an insertion force when the high vibration resistant connector 11 shown in FIG. 1 is fitted. A horizontal axis of the graph represents the stroke that changes from P3 to P0 in a fitting process and P0=0 mm in a fitting completed state. A vertical axis of the graph represents the insertion force. A dotted line in the graph represents a lock insertion load, a broken line represents a packing insertion load, a chain line represents a terminal insertion load, a two-dot chain line represents a spring load, and a solid line represents a total load.

Figure 8:
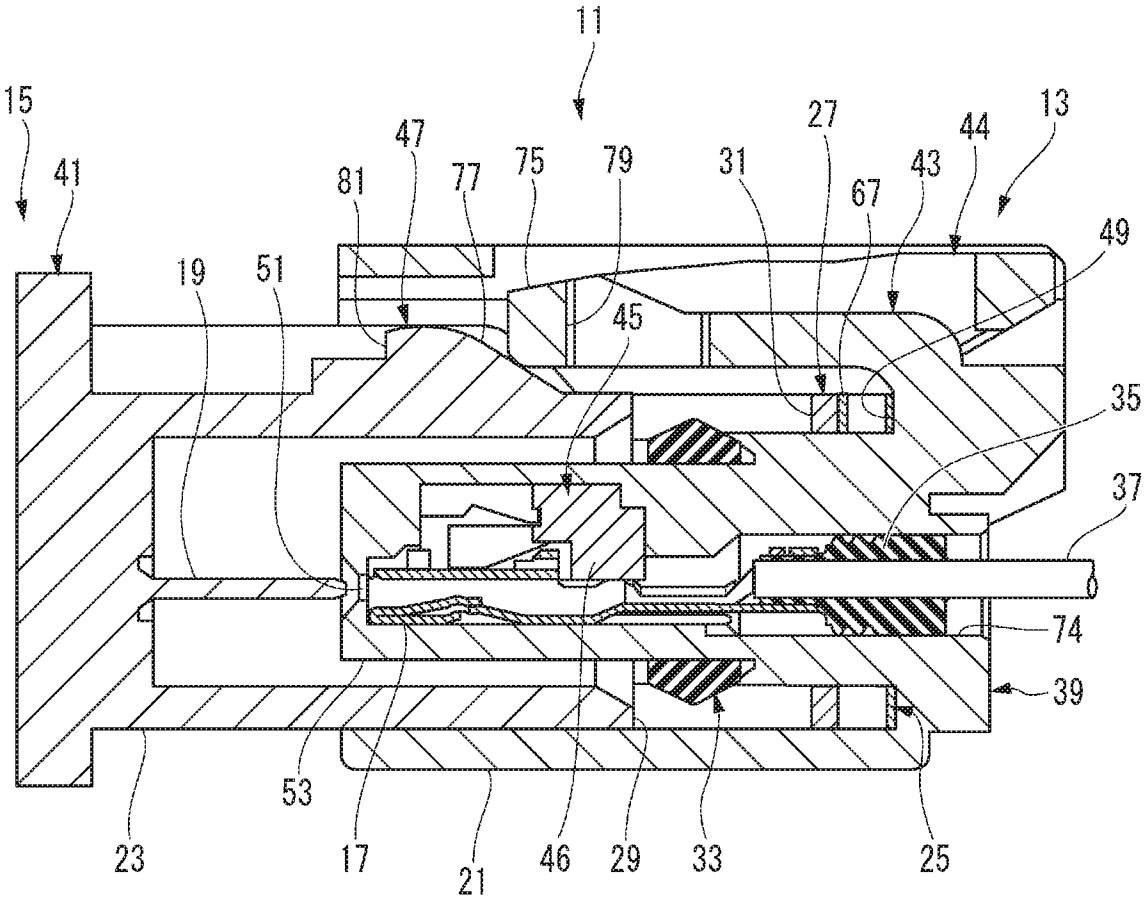
FIG. 8 is a longitudinal sectional view of the high vibration resistant connector in which contact between a lock arm and a lock projection is started.

FIG. 8 is a longitudinal sectional view of the high vibration resistant connector 11 in which contact between the lock arm 43 and the lock projection 47 is started.

In the connector structure according to the first embodiment, when fitting of the high vibration resistant connector 11 is started, as shown in FIG. 8, the lock arm 43 and the lock projection 47 start to contact each other. That is, the arm tip end portion 75 of the lock arm 43 comes into contact with an arm push-up inclined surface 77 of the lock projection 47. At this time, the lock insertion load starts to occur.

Figure 9:
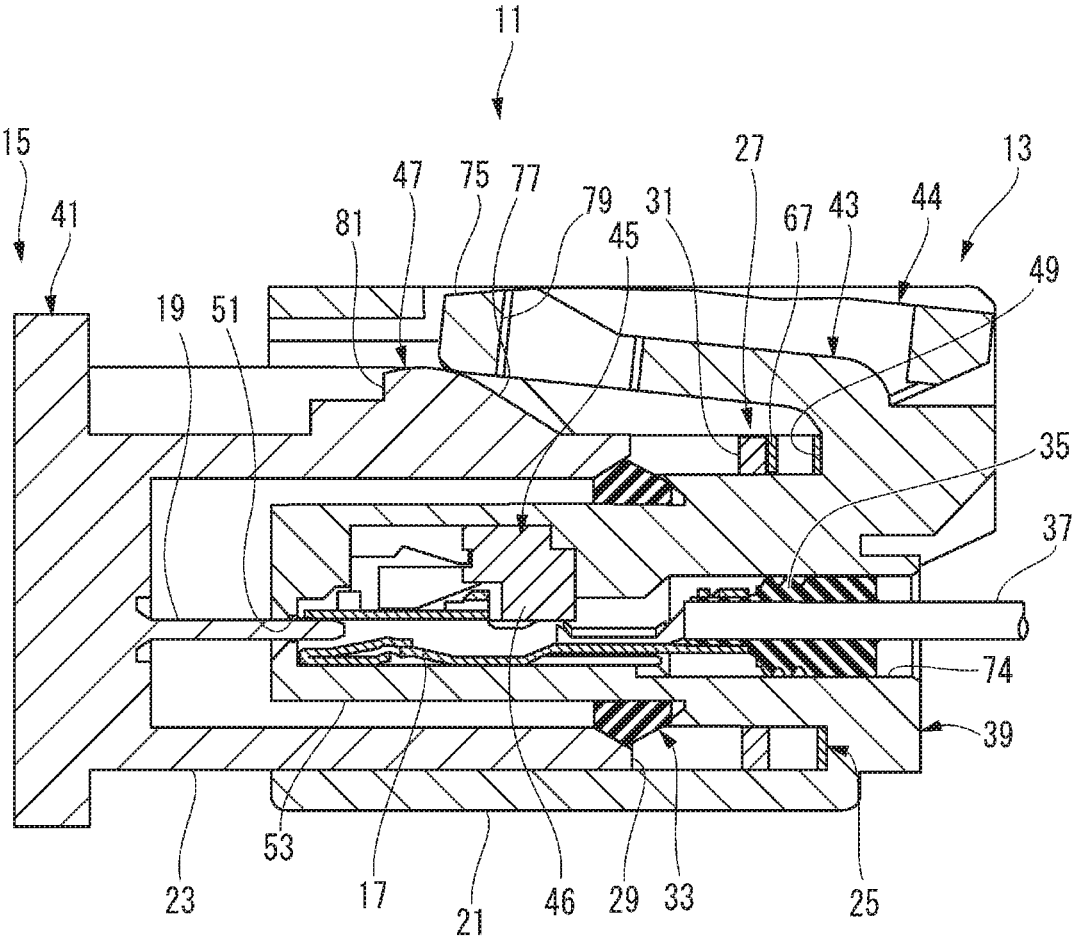
FIG. 9 is a longitudinal sectional view of the high vibration resistant connector in which the packing is started to be contacted.

FIG. 9 is a longitudinal sectional view of the high vibration resistant connector 11 in which the packing 33 is started to be contacted.

In a process of inserting the mating hood 23 into the fitting space 55 of the hood 21, as shown in FIG. 9, the packing 33 starts to enter the mating hood 23. At this time point (stroke position P3), the packing insertion load shown in FIG. 7 starts to occur. The arm tip end portion 75 goes up the arm push-up inclined surface 77.

Figure 10:
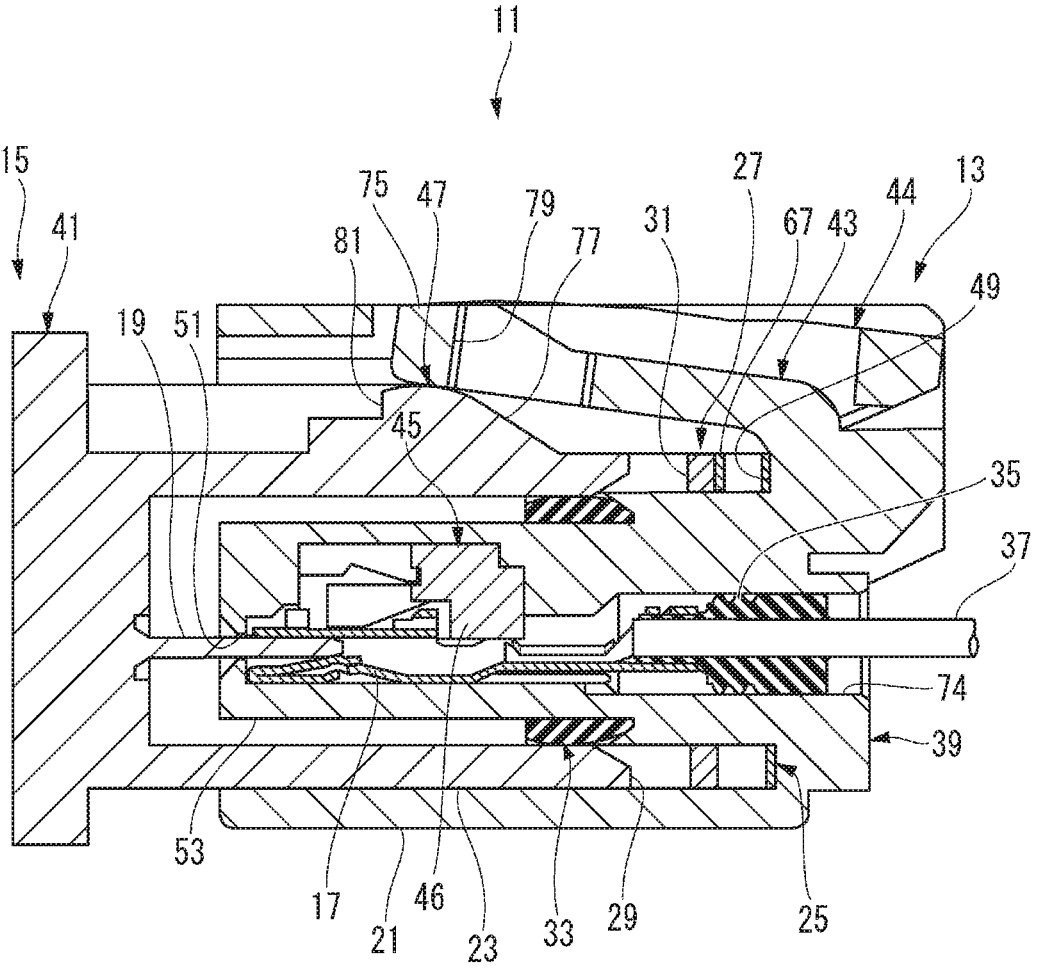
FIG. 10 is a longitudinal sectional view of the high vibration resistant connector in which contact between a terminal and a mating terminal is started.

FIG. 10 is a longitudinal sectional view of the high vibration resistant connector 11 in which contact between the terminal 17 and the mating terminal 19 is started.

Further, when the mating hood 23 is inserted into the hood 21, as shown in FIG. 10, the terminal 17 and the mating terminal 19 start to contact each other. At this time point (stroke position P2), the terminal insertion load shown in FIG. 7 starts to occur. Then, at a later time point (stroke position E), a connector insertion force D (lock insertion load A+packing insertion load B+terminal insertion load C) becomes maximum.

Figure 11:
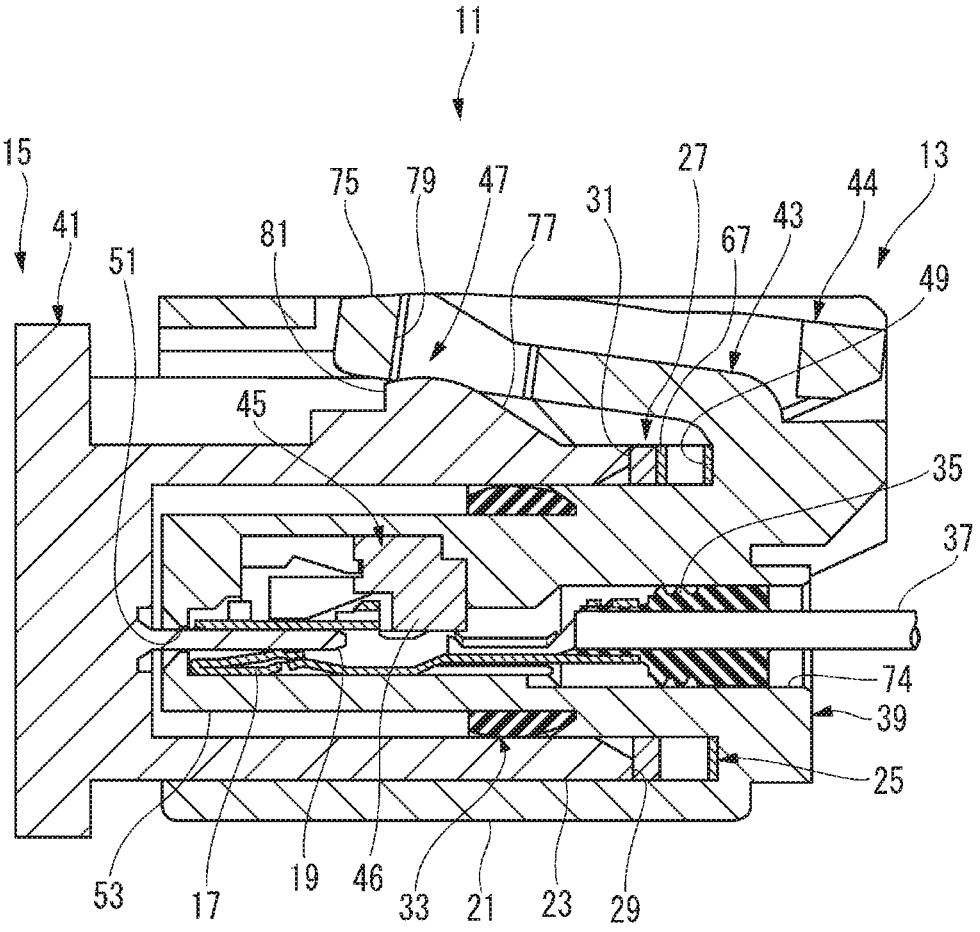
FIG. 11 is a longitudinal sectional view of the high vibration resistant connector in which contact between a mating hood and the backlash regulating member is started.

FIG. 11 is a longitudinal sectional view of the high vibration resistant connector 11 in which contact between the mating hood 23 and the backlash regulating member 27 is started.

When the mating hood 23 is further inserted into the hood 21, as shown in FIG. 11, the mating hood tip end surface 29 abuts against the regulating member abutting surface 31 of the backlash regulating member 27 (stroke position P1), and pressing by the plate spring member 25 is started.

Figure 12:
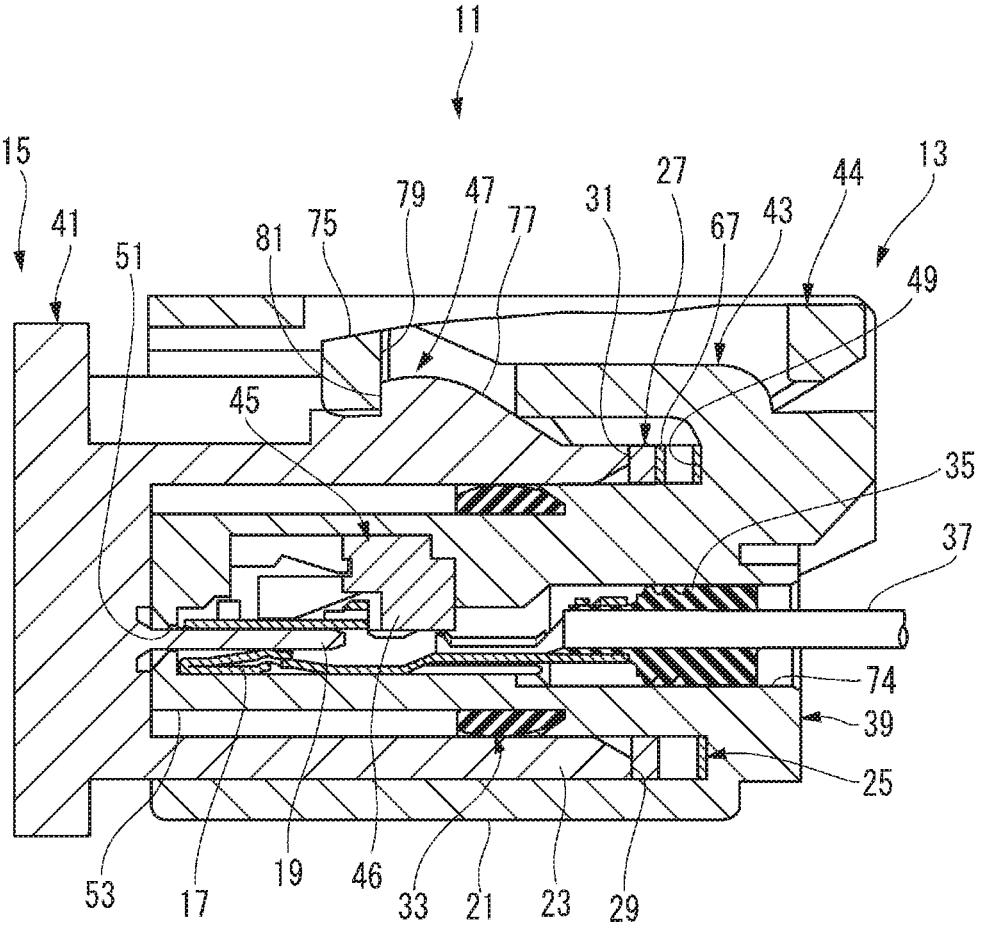
FIG. 12 is a longitudinal sectional view of the high vibration resistant connector that has been fitted.
Figure 13:
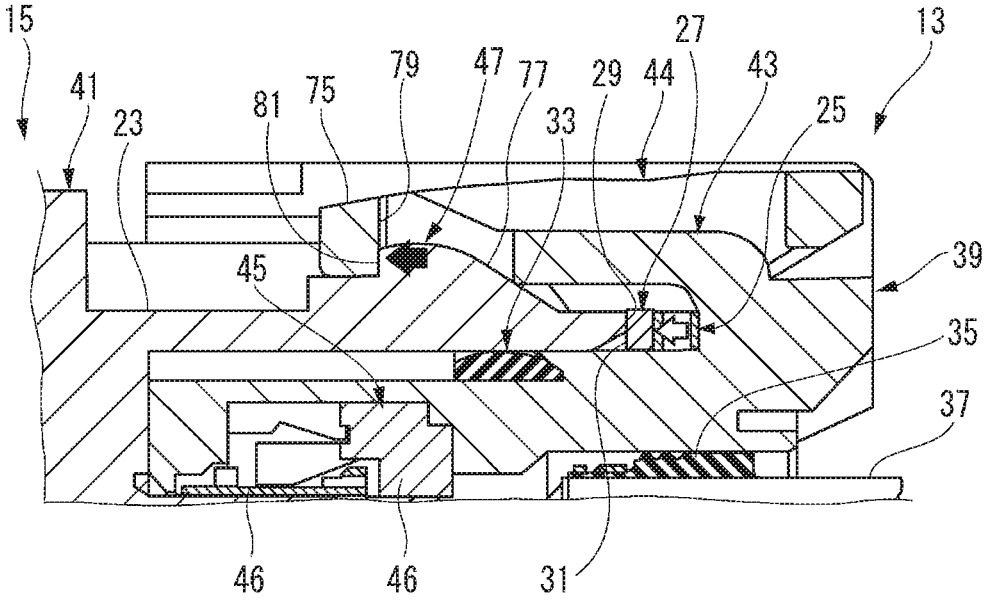
FIG. 13 is an enlarged view of a main part of FIG. 12.

FIG. 12 is a longitudinal sectional view of the high vibration resistant connector 11 that has been fitted, and FIG. 13 is an enlarged view of a main part of FIG. 12.

When the mating hood 23 is furthermore inserted into the hood 21, as shown in FIG. 12, the spring portion 67 of the plate spring member 25 is pressed by the backlash regulating member 27 to be elastically deformed, and an elastic repulsive force is generated in the spring portion 67. In the connector structure according to the first embodiment, at a stroke position P0, an arm side locking surface 79 of the lock arm 43 and a mating locking surface 81 of the lock projection 47 are locked to complete the fitting.

As described above, in the connector structure according to the first embodiment, an abutting start position of the mating hood tip end surface 29 (see FIG. 6) and the regulating member abutting surface 31 is set to the predetermined stroke position P1 after a fitting force of the housing 39 and the mating housing 41 reaches the maximum (after the stroke position E).

According to the connector structure of the first embodiment, the lock projection 47 and the lock arm 43 are engaged with each other in the fitted state of the high vibration resistant connector 11, and an abutting state between the mating hood tip end surface 29 and the regulating member abutting surface 31 of the backlash regulating member 27 is maintained.

Next, an action of the connector structure according to the first embodiment will be described.

In the connector structure according to the first embodiment, the connector 13 and the mating connector 15 are fitted and locked by the lock mechanism configured by the lock arm 43 and the lock projection 47, so that the fitting therebetween is regulated from being released. The connector structure according to the first embodiment is in a locked state in which the release of the fitting is regulated during use. The lock arm 43 is provided on the connector 13, and the lock projection 47 is provided on the mating connector 15, for example. Either of the lock arm 43 or the lock projection 47 configuring the lock mechanism may be provided on the connector 13 or the mating connector 15 as long as the lock arm 43 and the lock projection 47 relatively approach each other at the time of fitting.

The lock arm 43 provided in the connector 13 has the arm side locking surface 79 perpendicular to the fitting direction in a direction opposite to the fitting direction of the mating connector 15. Since the arm side locking surface 79 is disposed on the free end side of the lock arm 43, the arm side locking surface 79 can be displaced in a direction substantially perpendicular to the fitting direction of the mating connector 15. On the other hand, the lock projection 47 of the mating connector 15 is provided with the arm push-up inclined surface 77 having a downward slope that gradually decreases in the fitting direction (Z direction). That is, the arm push-up inclined surface 77 is an inclined surface gradually increasing toward the direction opposite side to the fitting direction (Z direction). The arm push-up inclined surface 77 is formed with the mating locking surface 81 that hangs substantially vertically at a top portion of a terminal end thereof that gradually increases.

When the connector 13 and the mating connector 15 are fitted, the lock arm 43 and the lock projection 47 approach each other. When the fitting is started, the arm push-up inclined surface 77 formed on the lock projection 47 abuts against the arm tip end portion 75 on which the arm side locking surface 79 is formed. When the fitting further proceeds, the arm tip end portion 75 is pushed up by the arm push-up inclined surface 77. That is, the arm tip end portion 75 goes up the arm push-up inclined surface 77. Immediately before the completion of the fitting, the arm tip end portion 75 reaches the top portion of the arm push-up inclined surface 77. In this state, the lock arm 43 is elastically deformed to the uppermost position.

Here, the arm tip end portion 75 needs to pass through the top portion of the arm push-up inclined surface 77. When the arm tip end portion 75 passes through the top portion of the arm push-up inclined surface 77, the lock arm 43 finishes riding on the arm push-up inclined surface 77. When the arm tip end portion 75 passes through the top portion, the lock arm 43 falls along the mating locking surface 81 by an elastic restoring force. Accordingly, the mating locking surface 81 and the arm side locking surface 79 face each other, and the connector 13 and the mating connector 15 is regulated from being detached. That is, the connector 13 and the mating connector 15 are locked in the fitted state by the lock mechanism.

At this time, the arm tip end portion 75 must slightly pass through the top portion so as to fall along the mating locking surface 81. A slight passing distance is an essential clearance for completing the locking of the lock mechanism.

The clearance in the lock mechanism remains even when the connector 13 and the mating connector 15 are in the locked state. That is, even in the fitted and locked state of the connector, the lock arm 43 and the lock projection 47 can move slightly relative to each other by the clearance.

Therefore, the terminal 17 accommodated in the housing 39 and the mating terminal 19 accommodated in the mating housing 41 can be finely slid by the clearance due to vibration during traveling of a vehicle or the like. When the fine sliding between the terminal 17 and the mating terminal 19 occurs over a long period of time, wear (that is, fine sliding wear) exceeds an allowable amount, and an electrical connection reliability may be reduced.

Therefore, in the connector structure according to the first embodiment, the plate spring member 25 made of metal is provided at the tube bottom 49 of the hood 21. The backlash regulating member 27 is provided on an opposite side of the tube bottom 49 across the plate spring member 25. The backlash regulating member 27 is urged by the plate spring member 25 in the direction opposite to the fitting direction (Z direction) of the mating hood 23. The backlash regulating member 27 is provided with the regulating member abutting surface 31. Immediately before the completion of the fitting, the regulating member abutting surface 31 is pressed by the mating hood tip end surface 29 formed at the tip end of the mating hood 23 in the fitting direction. The backlash regulating member 27 including the regulating member abutting surface 31 pressed by the mating hood tip end surface 29 compresses and deforms the spring portion 67 of the plate spring member 25 against a spring force (elastic restoring force).

As described above, the arm tip end portion 75 that has reached the top portion of the arm push-up inclined surface 77 passes through the top portion by the clearance and locks the arm side locking surface 79 to the mating locking surface 81. Even in movement by the clearance, the plate spring member 25 is compressed to accumulate the elastic restoring force. Therefore, when an insertion force for the fitting is released, the mating housing 41 of the mating connector 15 is urged by the elastic restoring force of the plate spring member 25 and pushed back in the direction opposite to the fitting direction.

Therefore, in the mating housing 41 of the mating connector 15 pushed back by the elastic restoring force of the plate spring member 25, the mating locking surface 81 of the lock projection 47 provided on the mating housing 41 is brought into close contact with the arm side locking surface 79 of the lock arm 43 provided on the housing 39, and the clearance in the lock mechanism can be eliminated. That is, the backlash by the clearance in the lock mechanism that fits and locks the housing 39 and the mating housing 41 is reduced. Accordingly, in the connector structure according to the first embodiment, in the fitted and locked state of the housing 39 and the mating housing 41, a movement between the mating locking surface 81 of the lock projection 47 and the arm side locking surface 79 of the lock arm 43 in an approaching/separating direction becomes impossible due to the clearance in the lock mechanism. As a result, in the connector structure according to the first embodiment, even when the vibration occurs when the vehicle is traveling or the like, the fine sliding between the terminal 17 accommodated in the housing 39 and the mating terminal 19 accommodated in the mating housing 41 can be suppressed.

In the connector structure according to the first embodiment, the plate spring member 25 that pushes back the mating housing 41 so as to eliminate the clearance in the lock mechanism is made of a metal elastic member. Therefore, the plate spring member 25 is less likely to creep due to aging such as an elastic member made of rubber or resin. That is, a push-back force acting on the mating housing 41 can be maintained for a long period of time. Therefore, the plate spring member 25 can maintain the elastic repulsive force of the spring portion 67 even in long-term use, and can suppress the backlash in the fitting direction between the housing 39 and the mating housing 41.

Therefore, according to the connector structure of the first embodiment, abrasion powder generated by the fine sliding wear between the terminal 17 and the mating terminal 19 can be suppressed from being an oxide insulator, so that a contact reliability between the terminal 17 and the mating terminal 19 can be suppressed from being reduced. Therefore, it is possible to maintain a good contact reliability over a long period of time.

In the connector structure according to the first embodiment, the fitting space 55 is effectively used by accommodating the plate spring member 25 and the backlash regulating member 27 in the fitting space 55 of the hood 21 into which the mating hood 23 is inserted. As a result, it is not necessary to ensure a dedicated backlash regulating space in other portions.

In the connector structure according to the first embodiment, the backlash regulating member 27 includes the displacement preventing projection 71 protruding toward the tube bottom 49. When the connector 13 and the mating connector 15 are fitted, the backlash regulating member 27 presses the plate spring member 25 toward the tube bottom 49 when the regulating member abutting surface 31 is pressed by the mating hood tip end surface 29. The spring portion 67 provided on the plate spring member 25 is compressed and deformed by this pressing. In a process of compressing and deforming the spring portion 67 of the plate spring member 25, the displacement preventing projection 71 abuts against the tube bottom 49 before displacement exceeding the elastic limit is applied.

Further displacement of the spring portion 67 of the plate spring member 25 is regulated. As a result, according to the connector structure of the first embodiment, the spring portion 67 of the plate spring member 25 can be prevented from being excessively deformed beyond the elastic limit and plastically deformed, so that a stable backlash reducing action can be maintained.

In the connector structure according to the first embodiment, the mating hood tip end surface 29 and the regulating member abutting surface 31 are abutted after the fitting force of the housing 39 and the mating housing 41 reaches the maximum. That is, in the fitting process of the housing 39 and the mating housing 41, the lock arm 43 first comes into contact with the lock projection 47 of the mating housing 41 in the lock mechanism, and the lock insertion load starts to occur. Next, the mating hood 23 and the packing 33 come into contact with each other, and the packing insertion load starts to occur. Then, the mating terminal 19 and the terminal 17 come into contact with each other, and the terminal insertion load starts to occur. As a result, all three of the lock insertion load, the packing insertion load, and the terminal insertion load, which are elements of the connector insertion force, are generated.

In the connector structure according to the first embodiment, the connector insertion force D is maximized in this state. In the connector structure according to the first embodiment, after the connector insertion force D reaches the maximum (after the stroke position E), the abutting of the mating hood tip end surface 29 and the regulating member abutting surface 31 is started. Accordingly, the spring load of the spring portion 67 of the plate spring member 25 starts to occur. When the spring load is generated (the predetermined stroke position P1), a time point when the connector insertion force becomes maximum has passed. That is, only the respective static loads are generated. As a result, the connector structure according to the first embodiment is configured such that generation of the spring load does not increase the connector insertion force D.

Next, a connector structure according to a second embodiment of the present invention will be described.

Figure 14:
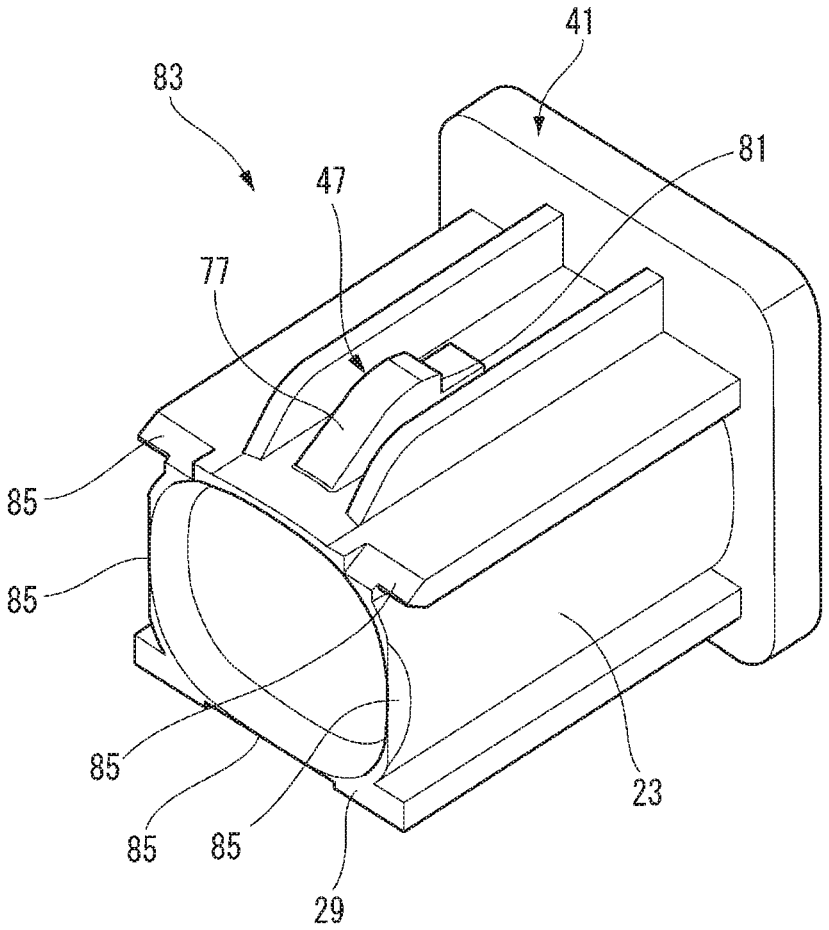
FIG. 14 is a perspective view of a mating connector in a high vibration resistant connector including a connector structure according to a second embodiment of the present invention.

FIG. 14 is a perspective view of a mating connector 83 in a high vibration resistant connector including a connector structure according to the second embodiment of the present invention.

In the connector structure according to the second embodiment, insertion portions 85 are formed on the mating hood tip end surface 29 of the mating connector 83. Each of the insertion portions 85 is formed of a wedge-shaped tapered surface that gradually becomes thinner toward the tip end. An angle of the wedge-shaped tapered surface of the insertion portion 85 is set at θ1 (see FIG. 16).

Figure 15:
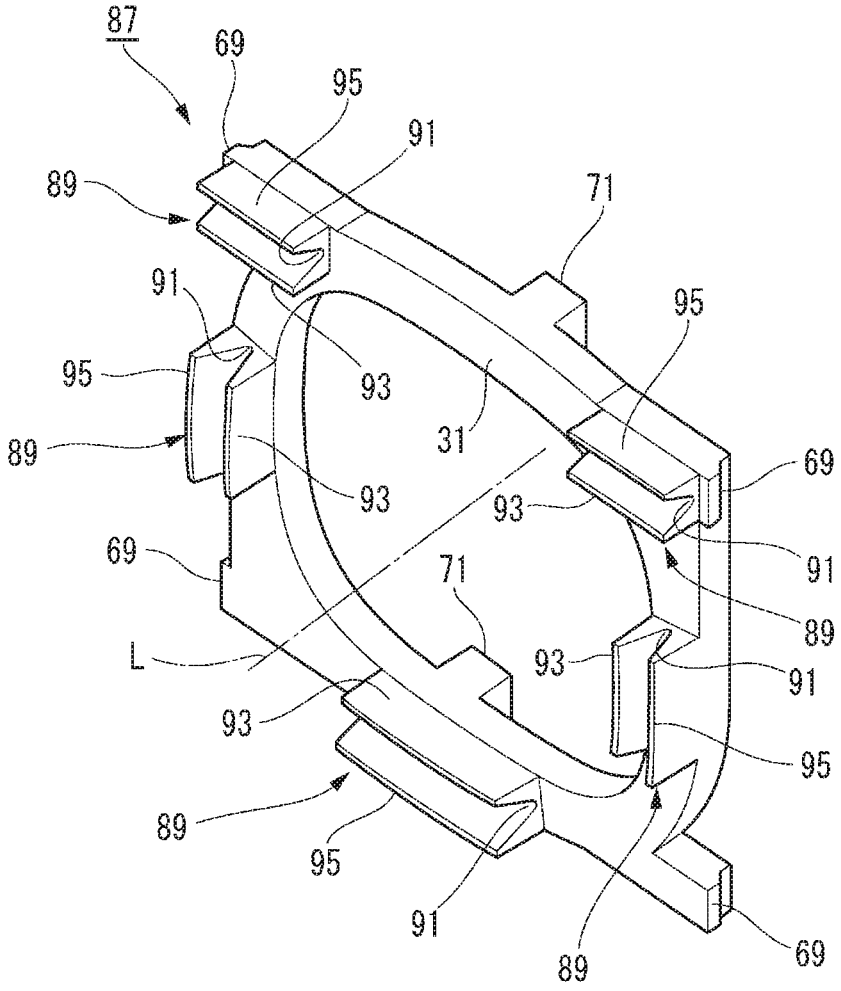
FIG. 15 is a perspective view of a backlash regulating member according to the second embodiment of the present invention.

FIG. 15 is a perspective view of a backlash regulating member 87 according to the second embodiment of the present invention.

In the connector structure according to the second embodiment, the regulating member abutting surface 31 of the backlash regulating member 87 is provided with backlash regulating protruding portions 89. A V-shaped groove 91 is formed on each of the backlash regulating protruding portions 89 by an inner side bending piece 93 bent toward the inside of the tube of the hood 21 and an outer side bending piece 95 bent toward the outside of the tube of the hood 21. The V-shaped groove 91 of the backlash regulating protruding portion 89 is pressed by the insertion portion 85.

In the connector structure according to the second embodiment, at least one backlash regulating protruding portion 89 is provided on the regulating member abutting surface 31 in an upper-lower direction (Y direction) and a left-right direction (X direction) that are respectively orthogonal to the tubular center axis L of the hood 21, and are orthogonal to each other.

Figure 16:
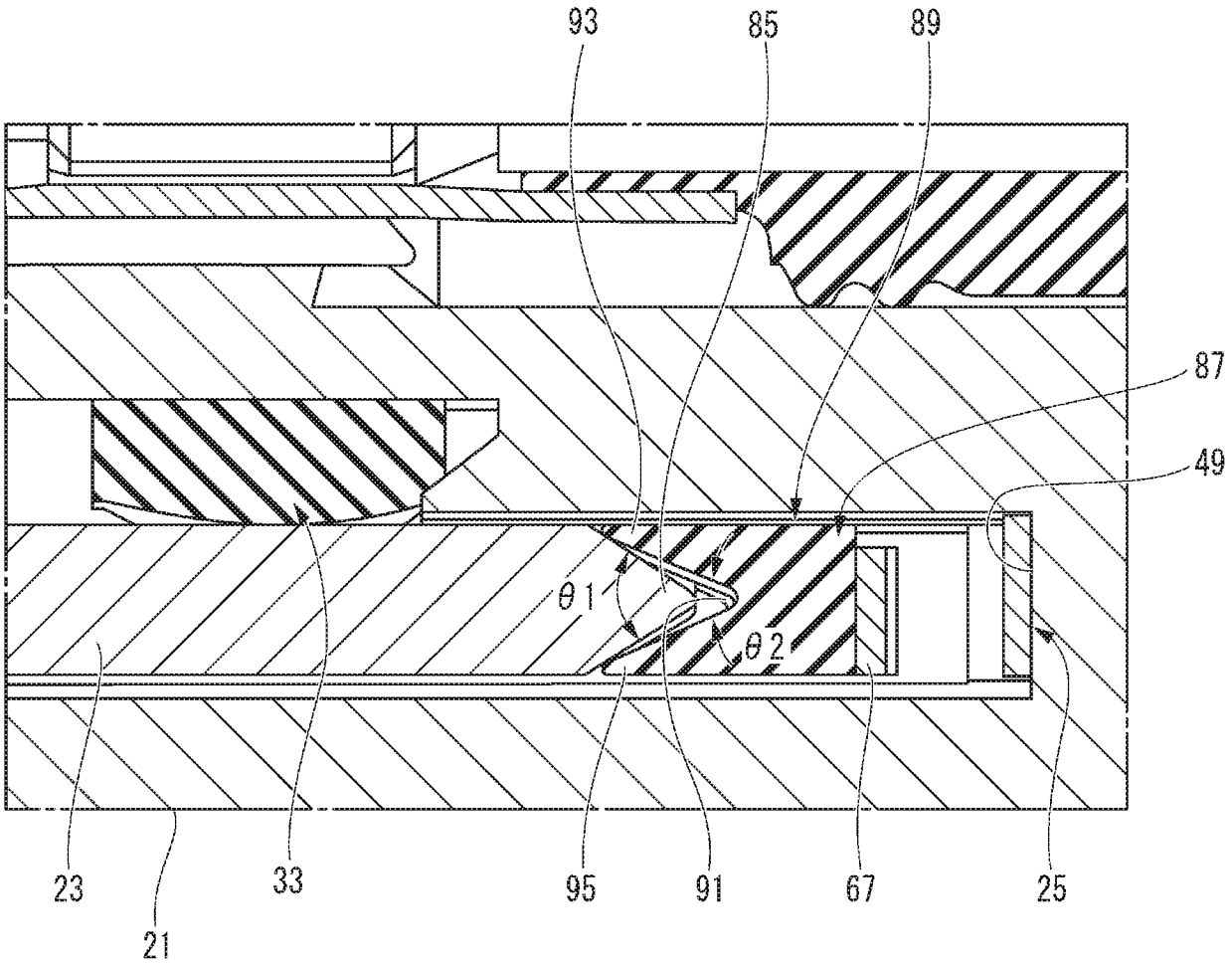
FIG. 16 is an enlarged view of a main part showing an angle of an insertion portion formed on a mating hood tip end surface and an angle of a V-shaped groove in the high vibration resistant connector according to the second embodiment of the present invention.

FIG. 16 is an enlarged view of a main part showing an angle of the insertion portion 85 formed on the mating hood tip end surface 29 and an angle of the V-shaped groove 91 in the high vibration resistant connector according to the second embodiment of the present invention.

The V-shaped groove 91 gradually approaches a groove inner wall on both sides toward a groove bottom. An interior angle of the V-shaped groove 91 is set to θ2. Here, the interior angle θ2 of the V-shaped groove 91 and the taper angle θ1 of the insertion portion 85 are set in a relationship of θ1>θ2.

Figure 17:
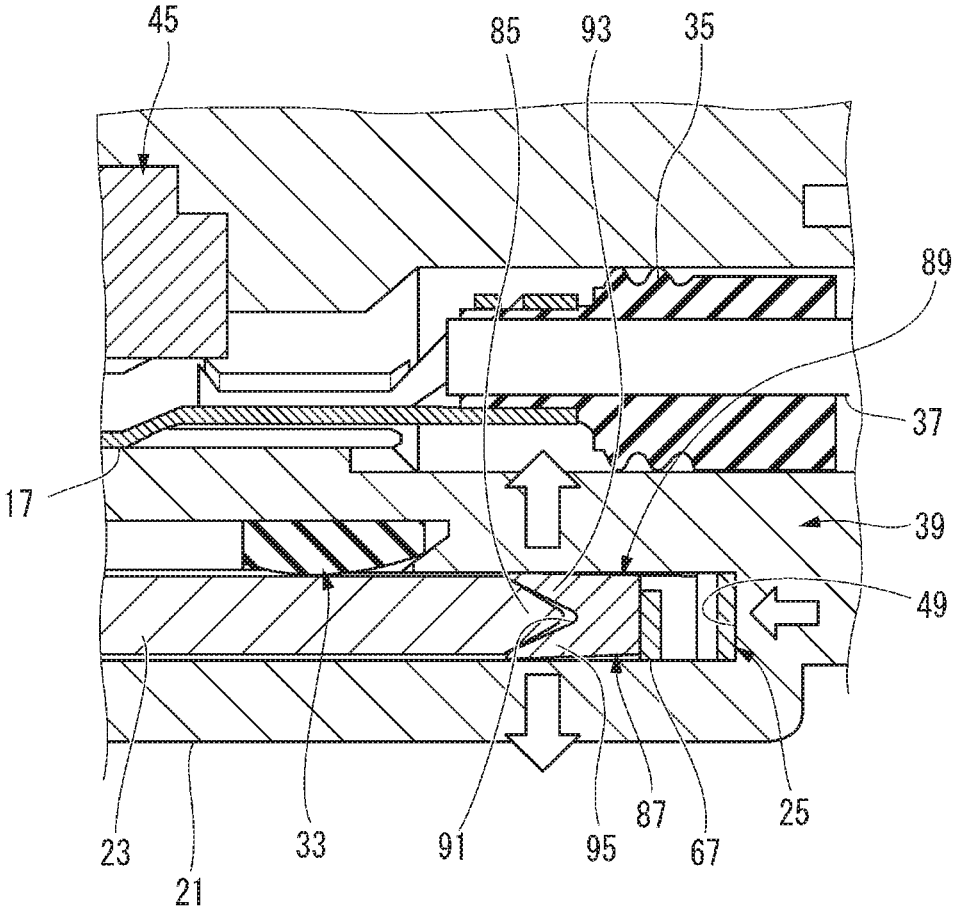
FIG. 17 is an operation explanatory view showing a backlash reducing action by the insertion portion and the V-shaped groove in the high vibration resistant connector according to the second embodiment of the present invention.
Figure 18:
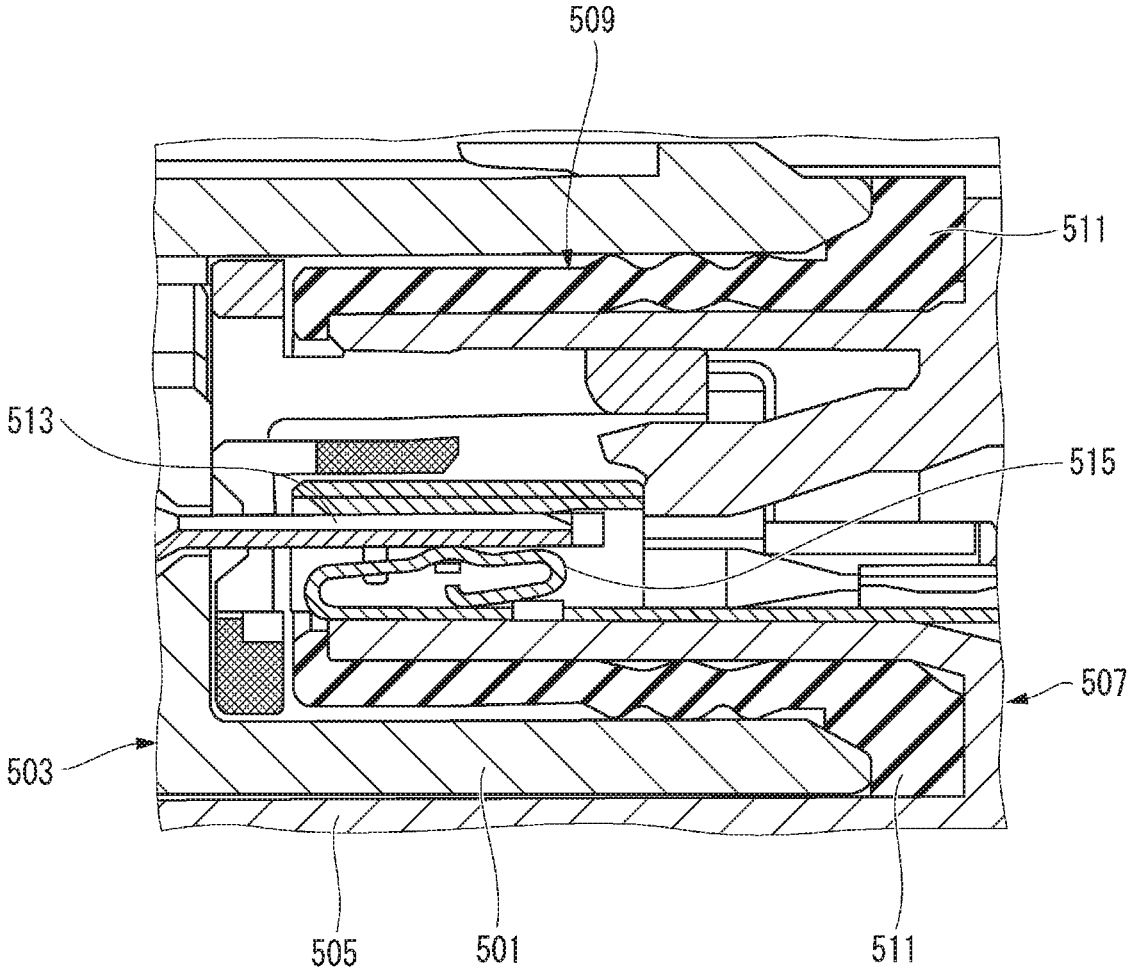
FIG. 18 is a longitudinal sectional view of a connector having a conventional connector structure.

FIG. 17 is an operation explanatory view showing a backlash reducing action by the insertion portion 85 and the V-shaped groove 91 in the high vibration resistant connector according to the second embodiment of the present invention.

In the connector structure according to the second embodiment, in the fitting process of the housing 39 of the connector 13 and the mating housing 41 of the mating connector 83, the insertion portion 85 formed on the mating hood tip end surface 29 is inserted into the V-shaped groove 91 of the backlash regulating protruding portion 89. When further inserted, the spring portion 67 of the plate spring member 25 is pressed and elastically deformed by the backlash regulating member 87, and the elastic restoring force is generated in the spring portion 67 of the plate spring member 25. Then, due to the urging of the elastic restoring force of the spring portion 67, the pointed wedge-shaped insertion portion 85 bends and deforms the inner side bending piece 93 and the outer side bending piece 95 of the backlash regulating protruding portion 89 configuring the V-shaped groove 91, respectively.

Therefore, in the fitted state of the housing 39 of the connector 13 and the mating housing 41 of the mating connector 83, the lock projection 47 and the lock arm 43 in the lock mechanism are engaged, and the wedge-shaped insertion portion 85 having a sharp tip end maintains the inner side bending piece 93 and the outer side bending piece 95 of the backlash regulating protruding portion 89 in a bent state. As a result, due to the bending of the inner side bending piece 93 and the outer side bending piece 95 provided in the backlash regulating protruding portion 89 of the backlash regulating member 87, backlash due to clearance in the upper-lower direction (Y direction) and the left-right direction (X direction) orthogonal to a housing fitting direction (Z direction) between the housing 39 and the mating housing 41 is suppressed.

Therefore, in the fitted state of the housing 39 of the connector 13 and the mating housing 41 of the mating connector 83, even if the vibration is applied to the vehicle, the fine sliding wear due to the terminal 17 and the mating terminal 19 is suppressed, and the electrical connection reliability is improved.

The backlash due to the clearance in the upper-lower direction (Y direction) and the left-right direction (X direction) orthogonal to the housing fitting direction (Z direction) is also suppressed by the restoring force due to the compression of the packing 33.

In the connector structure according to the second embodiment, at least four backlash regulating protruding portions 89 provided on the regulating member abutting surface 31 are provided on upper and lower sides of the regulating member abutting surface 31 that sandwich the tubular center axis L of the hood 21 vertically and left and right sides of the regulating member abutting surface 31 that sandwich the tubular center axis L of the hood 21 on the left and right. Incidentally, a pair of the backlash regulating protruding portions 89 according to the second embodiment is provided on one of the four sides (upper side of the regulating member abutting surface 31) with the tubular center axis L interposed therebetween. Therefore, a total of five backlash regulating protruding portions 89 are provided. As described above, in the connector structure according to the second embodiment, the five backlash regulating protruding portions 89 provided on the regulating member abutting surface 31 are arranged radially in four directions sandwiching the tubular center axis L in the upper-lower and left-right directions (Y, X directions).

The mating hood tip end surface 29 of the mating connector 83 abuts against the backlash regulating member 87 substantially uniformly in a radial direction (upper-lower and left-right directions) around the tubular center axis L. Accordingly, an urging force of the plate spring member 25 acting on the mating hood tip end surface 29 via the backlash regulating member 87 is substantially uniform in the radial direction around the tubular center axis L. As a result, the backlash regulating member 87 can maintain a high degree of parallelism with the tube bottom 49 of the connector 13 even when the plate spring member 25 is pressed or moved or when the mating hood 23 of the mating connector 83 is pushed back. Therefore, in the connector structure according to the second embodiment, it is possible to prevent the backlash regulating member 87 from being inclined with respect to the tube bottom 49 and causing the backlash reducing action to be uneven in the radial direction.

Therefore, according to the connector structure according to the above-described embodiments, a stable vibration resistant effect can be obtained even after aging.

The present invention is not limited to the embodiments described above, and may be appropriately modified, improved or the like. In addition, the material, shape, size, number, arrangement position, or the like of each component in the above-described embodiments are optional and are not limited as long as the present invention can be achieved.

Here, characteristics of the embodiments of the connector structure according to the present invention above will be briefly summarized in the following [1] to [5], respectively.

[1] A connector structure comprising:

a bottomed tubular hood (21) formed in a housing (39);

a mating hood (23) formed in a mating housing (41) and fitted inside the hood;

a plate spring member (25) made of metal accommodated in a tube bottom (49) of the hood;

a backlash regulating member (27, 87) provided on an opposite side of the tube bottom across the plate spring member and urged in a direction opposite to a fitting direction (Z direction) of the mating hood by the plate spring member;

a mating hood tip end surface (29) formed at a tip end of the mating hood in the fitting direction; and a regulating member abutting surface (31) provided on the backlash regulating member and pressed by the mating hood tip end surface in a fitted state that the housing and the mating housing are fitted.

[2] The connector structure according to [1] further comprising:

an insertion portion (85) formed on the mating hood tip end surface (29); and a backlash regulating protruding portion (89) provided on the regulating member abutting surface (31) and including a V-shaped groove (91) formed by an inner side bending piece (93) bent toward an inside of a tube of the hood (21) and an outer side bending piece (95) bent to an outside of the tube of the hood, wherein the V-shaped groove of the backlash regulating protruding portion is pressed by the insertion portion.

[3] The connector structure according to [2], wherein at least one backlash regulating protruding portion (89) is provided on each of the regulating member abutting surfaces (31) in an upper-lower direction (Y direction) and a left-right direction (X direction) which are orthogonal to a tubular center axis (L) of the hood (21) and orthogonal to each other.

[4] The connector structure according to any one of [1] to [3], wherein the backlash regulating member (27, 87) is provided with a displacement preventing projection (71) abutting against the tube bottom (49), and wherein the displacement preventing projection (71) is configured to prevent from an excessive displacement of the plate spring member (25).

[5] The connector structure according to any one of [1] to [4], wherein an abutting start position of the mating hood tip end surface (29) and the regulating member abutting surface (31) is set to a predetermined stroke position (P1), so that the mating hood tip end surface (29) and the regulating member abutting surface (31) are abutted after a fitting force of the housing (39) and the mating housing (41) reaches a maximum.

DESCRIPTION OF REFERENCE NUMERALS AND SIGNS

11 high vibration resistant connector
21 hood
23 mating hood
25 plate spring member
27 backlash regulating member
29 mating hood tip end surface
31 regulating member abutting surface
39 housing
41 mating housing
49 tube bottom
71 displacement preventing projection
85 insertion portion
87 backlash regulating member
89 backlash regulating protruding portion
91 V-shaped groove
93 inner side bending piece
95 outer side bending piece
P1 predetermined stroke position

What is claimed is:

1. A connector structure comprising:

a bottomed tubular hood formed in a housing;

a mating hood formed in a mating housing and fitted inside the bottomed tubular hood;

a metal plate spring member accommodated in a tube bottom of the bottomed tubular hood;

a backlash regulating member provided on an opposite side of the tube bottom across the plate spring member and urged in a direction opposite to a fitting direction of the mating hood by the plate spring member;

a mating hood tip end surface formed at a tip end of the mating hood in the fitting direction;

a regulating member abutting surface provided on the backlash regulating member and pressed by the mating hood tip end surface in a fitted state that the housing and the mating housing are fitted;

an insertion portion formed on the mating hood tip end surface; and a backlash regulating protruding portion provided on the regulating member abutting surface and including a V-shaped groove formed by an inner side bending piece bent toward an inside of a tube of the bottomed tubular hood and an outer side bending piece bent to an outside of the tube of the bottomed tubular hood, wherein the V-shaped groove of the backlash regulating protruding portion is pressed by the insertion portion.

2. The connector structure according to claim 1, wherein at least one backlash regulating protruding portion is provided on each regulating member abutting surface in an upper-lower direction and a left-right direction which are orthogonal to a tubular center axis of the bottomed tubular hood and are orthogonal to each other.

3. The connector structure according to claim 1, wherein the backlash regulating member is provided with a displacement preventing projection abutting against the tube bottom, and wherein the displacement preventing projection is configured to prevent an excessive displacement of the plate spring member.

4. The connector structure according to claim 1, wherein an abutting start position of the mating hood tip end surface and the regulating member abutting surface is set to a predetermined stroke position, so that the mating hood tip end surface and the regulating member abutting surface are abutted after a fitting force of the housing and the mating housing reaches a maximum.

* * * * *